US005390812A

United States Patent [19]

Spiro

[11] Patent Number: 5,390,812

[45] Date of Patent: Feb. 21, 1995

[54] WASTEBASKET LINER REMOVAL DEVICE

[76] Inventor: Robert B. Spiro, 1101 Rock Pointe Look, Woodstock, Ga. 30188

[21] Appl. No.: 253,542

[22] Filed: Jun. 3, 1994

[51] Int. Cl.[6] ..... B65D 90/04

[52] U.S. Cl. ..... 220/403; 220/404; 220/629; 220/908

[58] Field of Search ..... 220/403, 404, 625, 628, 220/629, 630, 636, 729, 908

[56] References Cited

U.S. PATENT DOCUMENTS

| | | | |
|---|---|---|---|
| 1,228,813 | 6/1917 | Osley . | |
| 1,286,368 | 12/1918 | Lucas . | |
| 2,545,320 | 3/1951 | Tilson et al. | 248/346 |
| 2,574,270 | 11/1951 | Leonard | 248/146 |
| 2,911,180 | 11/1959 | Dunagan et al. | 248/346 |
| 3,115,986 | 12/1963 | Groff | 220/403 |
| 3,664,628 | 5/1972 | Noble | 248/350 |
| 3,997,072 | 12/1976 | Guth | 220/404 X |
| 4,054,225 | 10/1977 | Frech | 220/403 X |
| 4,363,417 | 12/1982 | Rhoades et al. | 220/1 T |
| 4,484,682 | 11/1984 | Crow | 220/628 X |
| 4,666,054 | 5/1987 | Jaicks | 220/908 X |
| 4,842,228 | 6/1989 | Kasper | 220/908 X |
| 5,163,579 | 11/1992 | Jones | 220/629 |

*Primary Examiner*—Steven M. Pollard
*Attorney, Agent, or Firm*—Hopkins & Thomas

[57] ABSTRACT

A wastebasket liner removal device (1) having a generally rectangular frame (8). A plurality of elongated ribs (17) extend between the ends (11, 12) of the frame, and a plurality of cross ribs (18) extend between the sides (9, 10) of the frame. The frame is also provided with a plurality of mounting flanges (20), each mounting flange having a fastener opening (21) defined therein and passing therethrough for passing a fastener to connect frame (8) to the bottom (3) of a conventional wastebasket (2). Device (1) has a pair of opposed footpads (25) supported on the frame. Each footpad is generally rectangular in shape, and is sized and shaped to be held on frame (8) in a retracted position, and to be moved into a generally horizontal extended position so that footpads (25) may be stood on while removing wastebasket liner (6) from the wastebasket.

18 Claims, 3 Drawing Sheets

WASTEBASKET LINER REMOVAL DEVICE

FIELD OF THE INVENTION

The present invention relates in general to wastebaskets. More particularly, the present invention relates to a device to be attached to a wastebasket for use in holding the wastebasket in position as a liner is removed from the wastebasket or trash receptacle.

BACKGROUND OF THE INVENTION

It is common practice in most homes and businesses to have a wastebasket or trash receptacle which is lined with a removable wastebasket liner, typically a polyethylene bag or the like. During the day, or over a period of days, refuse is collected in the wastebasket until the wastebasket is to be emptied whereupon the wastebasket liner is removed from the wastebasket or trash receptacle. However, as oftentimes happens, as refuse or trash is collected in the wastebasket the wastebasket liner expands as trash is placed in the wastebasket, so that the refuse collected and compacted in the wastebasket liner presses against the inside wall or walls of the wastebasket. Thus, as the wastebasket liner is drawn upward out of the wastebasket, the wastebasket is carried upward off of the floor with the bag, only to fall off due to the force of gravity, or when the wastebasket and liner are pulled apart by the person charged with the task of emptying the wastebasket. This problem can occur in every type and configuration of wastebasket using a removable wastebasket liner. Perhaps the most common example of this event is the removal of a wastebasket liner from a "kitchen" wastebasket, which oftentimes contains food scraps, newspapers, and other solid waste materials. As refuse is collected in the wastebasket, it compacts downward and expands outward, so that the bag presses against the wall of the wastebasket.

An early attempt of providing an apparatus for holding a garbage receptacle in position while an inner receptacle is removed therefrom is disclosed in U.S. Pat. No. 1,286,368 to Lucas, issued Dec. 3, 1918. In Lucas, a cylindrical container is provided with a pair of opposite directed footpieces rigidly affixed to the bottom of the container. The container also has a hopper housed inside the cylindrical container, over which a cover is closed. Garbage is placed into the hopper and collected therein. When it is desired to remove the hopper from the container the cover to the hopper is removed, one or both of the footpieces can be stood upon by the person removing the hopper, and the hopper drawn up and out of the container.

In U.S. Pat. No. 4,363,417 to Rhoades, et al, issued Dec. 14, 1982, a dustless container for ashes or the like is disclosed having an ash container with a removable lid received thereon, as well as a door provided in the wall of the ash container for receiving ashes or other material to be deposited in the container. At the bottom of the container a single toe recess means is provided for holding the container in position while the cover is lifted upward off of the container for dumping the ash or other material collected in the container. The toe recess formed in the container is recessed into the container wall, and formed as a part of the container itself.

A more recent approach is disclosed in U.S. Pat. No. 5,163,579 to Jones issued Nov. 17, 1992. In Jones a wastebasket is provided that has an integral recess cut into the side wall of the wastebasket. A pedal is pivotally mounted on one end at the bottom of the recessed area and held in a normally retracted position with a spring in contact with the wall of the recess and the foot pedal. The foot pedal has a tab which is curved outward so that the person desiring to remove a liner from the wastebasket can attempt to catch the tab of the foot pedal to push the foot pedal down against the spring, holding the foot pedal in position while the wastebasket liner is drawn upward and out of the wastebasket.

Unlike the patent to Lucas, in which the foot pieces are affixed to the outside of the waste container, and the patent to Rhoades, in which the toe recess is formed as a recess in the wall of the container, the foot pedal of Jones is housed in a recessed area cut into the side wall of the waste receptacle. Also, and unlike Rhoades, the foot pedal of Jones is affixed to the side of the wastebasket, and is not located in a central portion of the wastebasket, so that the wastebasket can possibly pivot about the end of the foot pedal pivotally held within the recess as the wastebasket liner is drawn out of the wastebasket of Jones. The problem may also arise in using the invention disclosed in the patent to Jones that if the person seeking to remove the wastebasket liner has large feet, or is barefoot, they may have trouble engaging the tab of the foot pedal to pivot it downward against the floor while the wastebasket liner is removed, or they may stub their toe while attempting to move the tab of the foot pedal down, or catch their toe on the recess on the side of the wastebasket while pushing the foot pedal downward.

Thus, the need exists for a device which can be attached to a wastebasket and provides a simple yet efficient means for assisting a person in removing the wastebasket liner from the wastebasket by holding the wastebasket in place as the wastebasket liner is drawn upward. Moreover, the need exists for a device which is not formed as an integral part of the wastebasket, thus enabling the device to be retrofit to existing wastebaskets. Also, the need exists for a device which provides foot pedals which can be moved into a stored or retained position in the event the wastebasket is moved or placed in storage, and extended downward into a working position to both stabilize the wastebasket and provide a device to hold the wastebasket in position as a wastebasket liner is removed therefrom.

SUMMARY OF THE INVENTION

The present invention provides an improved wastebasket liner removal device which can be quickly and easily fit, or retrofit, to any new or existing wastebasket, is compact in appearance, and has an opposed pair of footpads which can be easily moved into an extended position so that the consumer can place one or two feet on the device to stabilize the wastebasket as a wastebasket liner held inside the wastebasket is drawn upward and out of the wastebasket for disposal. This is accomplished through a device having a frame fastened to the bottom of the wastebasket, a pair of opposed footpads movably supported on the frame, where each footpad can be moved into a retracted position and into a generally horizontal extended position for use in stabilizing, and holding, the wastebasket in position, as a wastebasket liner is removed therefrom.

The frame has a pair of spaced apart sides, and a pair of spaced apart ends, the sides and ends of the frame being joined to one another along their common edges to form a generally rectangular frame. The top of the frame is conventionally attached to the bottom of a wastebasket. Supported on the frame are a pair of opposed footpads, each footpad having two generally opposed sides, a front end, a rear end, and a top piece forming the pedal upon which the person or persons using the wastebasket may place their feet. The footpad can be housed in the frame in an elongated track, shipped with the footpads in a retracted position, and the footpads moved outward into a generally horizontal extended position for use. The footpad can also be formed as an integral part of the frame, having an elongated continuous hinge attaching the rear end of each footpad and to the end of the frame.

Thus, it is an object of the present invention to provide an improved wastebasket liner removal device which can be quickly and easily fit, or retrofit, to any new or existing wastebasket, respectively.

It is another object of the present invention to provide a wastebasket liner removal device which can be attached to a wastebasket without having to form a recess in the side or sides of the wastebasket, or without having to cut a recess into the side or sides of the wastebasket.

It is still another object of the present invention to provide a wastebasket liner removal device which can stabilize the wastebasket when it is attached to the wastebasket, and can hold the wastebasket in a stable position as the wastebasket liner is removed therefrom.

A further object of the present invention is to provide an improved wastebasket liner removal device in which the footpads can be moved into a retracted position so that the wastebasket liner removal device, and/or a wastebasket to which the device is attached, can be easily shipped or moved to a different location, whereupon the footpads can be moved into their extended position to once again stabilize the wastebasket.

A further object of the present invention is to provide a wastebasket liner removal device which is simple in design and inexpensive to construct, is durable and rugged in structure and can be easily fit or retrofit to wastebaskets.

These and other objects, features, and advantages of the invention will become apparent upon reading the specification when taken in conjunction with the accompanying drawings, wherein like characters of reference designate corresponding parts throughout the several views.

DETAILED DESCRIPTION OF THE PREFERRED EMBODIMENT

Figure 1:
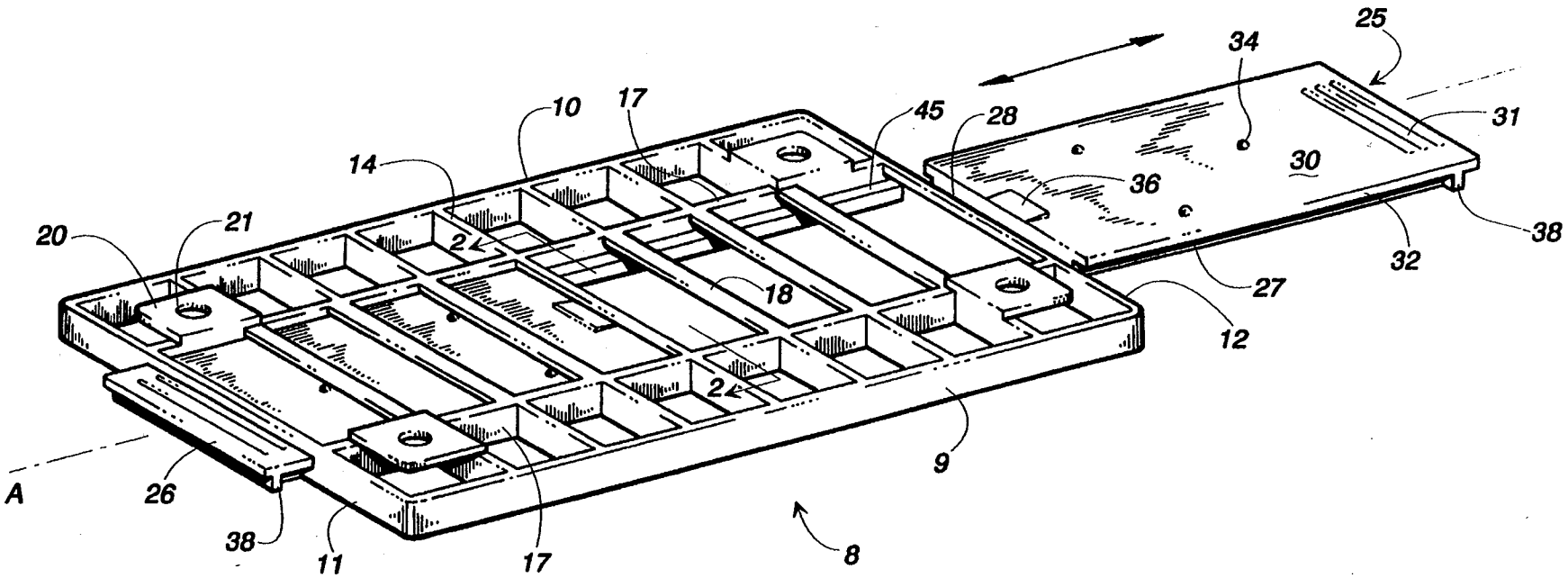
FIG. 1 is a perspective view of the wastebasket liner removal device.
Figure 3:
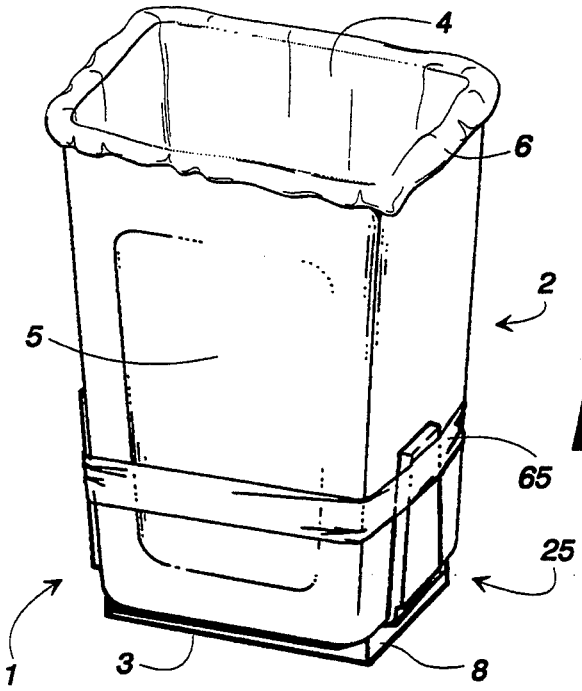
FIG. 3 is a perspective view of an alternate embodiment of the wastebasket liner removal device.

Referring now in detail to the drawings, in which like reference numerals indicate like parts throughout the several views, numeral 1 in FIG. 1 illustrates the wastebasket liner removal device. As shown in FIG. 3, device 1 is adapted for use with a conventional wastebasket or trash receptacle 2 having a closed bottom 3, an open top 4, and a side or sides 5 attached to bottom 3 along their common edges to form a receptacle for receiving trash or debris therein. Wastebasket 2 is provided here with a removable liner 6. Liner 6 is a conventional garbage or refuse bag, to include polyethylene bags and other plastic bags constructed for use as a wastebasket liner.

Returning now to FIG. 1, device 1 has a frame 8 of generally rectangular shape, having a pair of spaced apart sides 9 and 10, and ends 11 and 12. Sides 9 and 10 are joined to ends 11 and 12 along their common edges to form the frame. Frame 8 has a top 14, and a bottom 15. Top 14 is placed adjacent the bottom 3 of wastebasket 2, whereas bottom 15 of frame 8 will be placed against the floor or other bearing surface of the structure in which the wastebasket is used.

Frame 8 also has a plurality, in this instance, two, elongated ribs 17 located between sides 9 and 10 of frame 8, and extending between, and connected to, ends 11 and 12 of the frame. Elongated ribs 17 are parallel to one another, and parallel to the sides of the frame. Frame 8 also has a plurality of cross-ribs 18 located intermediate the ends 11 and 12 of frame 8, and extending between, and connected to, each of sides 9 and 10 of the frame. Frame 8 does not require any specific number of cross ribs 18, the number of cross ribs depending on the size of frame 8. Frame 8, as illustrated in FIG. 1, does require at least two (2) of elongated ribs 17, or their structural equivalent.

Figure 4:
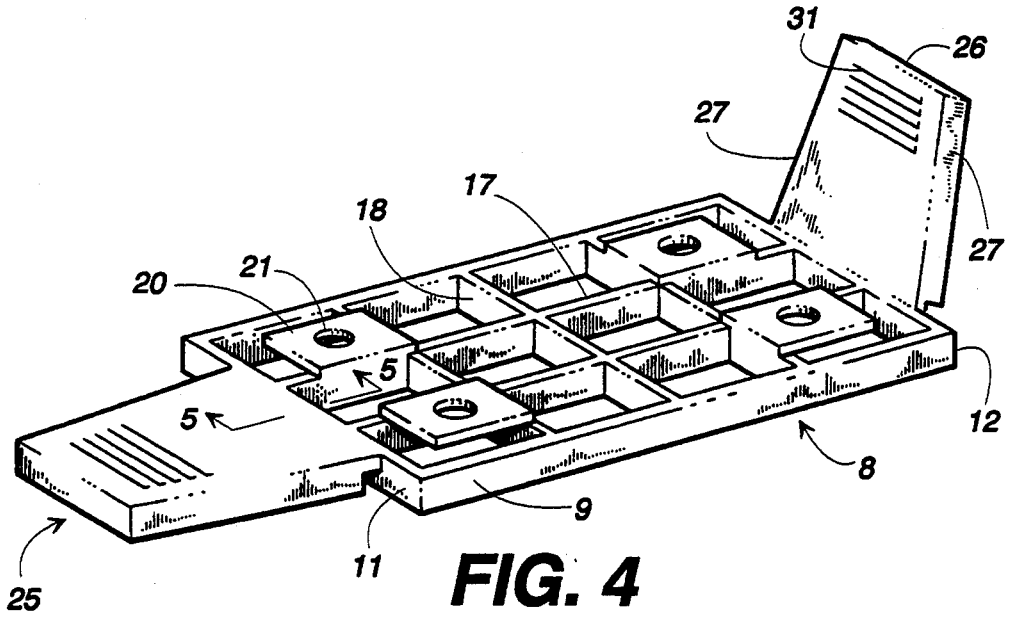
FIG. 4 is a perspective view of the wastebasket liner removal device illustrated in FIG. 3.

As best shown in FIGS. 1 and 4, four (4) mounting flanges 20 are provided on top 14 of frame 8. Each mounting flange 20 is coplanar with the other, so that each flange 20 lies in a common horizontal plane above the surface of elongated ribs 17 and cross ribs 18. A fastener opening 21 is defined within each mounting flange 20, and passes therethrough for passing a conventional fastener (not illustrated) through the mounting flange and into the bottom 3 of wastebasket 2. Although device 1 is illustrated as having mounting flanges 20 with fastener openings 21 located therein, it is anticipated that device 1 can be attached to bottom 3 of wastebasket 2 through conventional means, to include placement upon a locking or spring pin or pins extending from the bottom of the wastebasket, or can be affixed to the bottom of the wastebasket with an adhesive, or can even be formed as an integral assembly with the bottom of the wastebasket during the manufacture of the wastebasket, as illustrated generally in FIG. 3.

Figure 2:
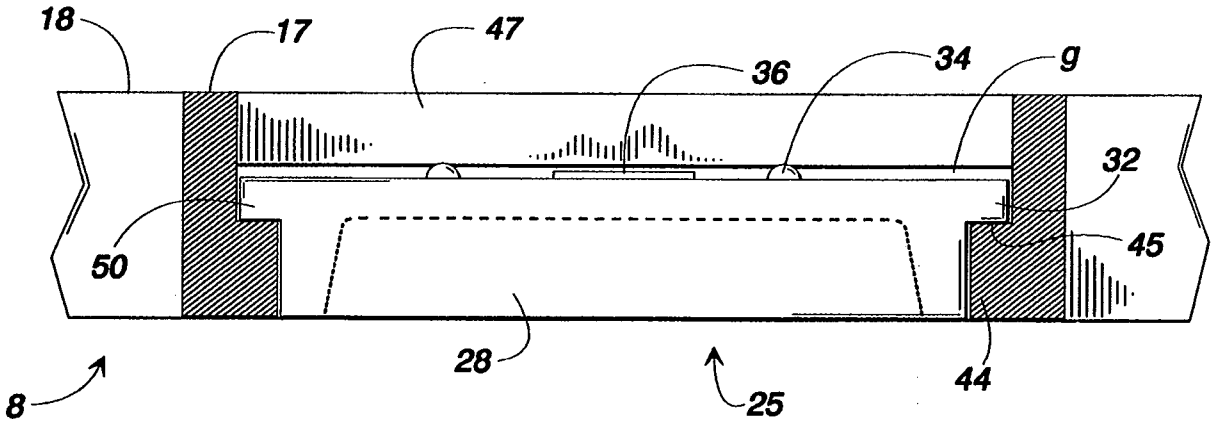
FIG. 2 is a cross sectioned elevational view along line 2—2 of FIG. 1.
Figure 5:
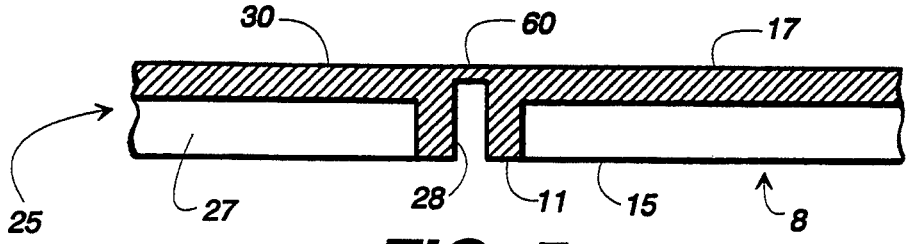
FIG. 5 is a partial cross sectioned elevational view along line 5—5 of FIG. 4.

Referring now to FIG. 1, device 1 is provided with a pair of footpads 25. Each footpad 25 has a front end 26, a pair of generally opposed sides 27, and a rear end 28. Front end 26, sides 27 and rear end 28 are joined along their common edges to form a generally rectangular footpad. Footpad 25 also has a top piece 30 which is affixed along the common edges of front end 26, sides 27, and rear end 28 to fully form footpad 25. As constructed, and as illustrated in FIGS. 2 and 5, a recess will be formed within the footpad below top piece 30. Although footpad 25 is shown as having a recess, it is possible that footpad 25 can be constructed as one solid piece without a recess.

As best shown in FIGS. 1 and 4, top piece 30 of footpad 20 is provided with a series of slotted recesses 31 toward the front end 26 of each footpad. These are provided for the purposes of providing a friction surface on the face of the footpad against which a person's foot can remain on the footpad, and as shown in FIG. 1, to provide a recessed ridge which can be used to draw the footpad out of elongated track 40 of frame 8, as discussed in greater detail below.

Referring now to FIG. 1, in the preferred embodiment of this invention footpad 25 is provided with a pair of elongated flanges 32 formed along each side 27 of footpad's 25 top piece 30. Flange 32 extends from the front end 26 to the rear end 28 of each footpad 25. A plurality, in this instance three (3), of spherical stops 34 are recessed into the surface of top piece 30, and extend upwardly away from top piece 30. The use of spherical stops 34 will be explained in greater detail below. Spherical stops 34 can be any hard, durable, and rigid spherical body, and are in this instance shown as metallic ball bearings recessed into top piece 30. A raised stop 36 is provided at the rear end of top piece 30. Raised stop 36 is formed in top piece 30, and, like spherical stops 34, extends upward and away from the surface of top piece 30. Lastly, each of footpads 25 in FIG. 1 is provided with a lip 38 at the front end 26 of the footpad, which acts as a stop for holding the footpad in position in frame 8 when the footpad is moved into its retracted position inside the frame.

As best shown in FIG. 1, frame 8 is provided with an elongated track 40. Elongated track 40 supports each of footpads 25 inside frame 8, so that footpad 25 can be moved into its generally retracted position, as shown by the left footpad illustrated in FIG. 1, and provide a means for supporting footpad 25 as it is moved along track 40 and extended into its generally horizontal position to support the wastebasket, both when a wastebasket liner is removed therefrom, as well as when the wastebasket is used for collecting refuse. A pair of openings 42, one each in ends 11 and 12 of frame 8, is provided, the openings being in communication with elongated track 40. Elongated track 40 is formed by two of elongated ribs 17 extending between openings 42 in frame 8. As best shown in FIGS. 1 and 2, an inwardly facing protrusion 44 is formed on the inside of elongated rib 17. Protrusion 40 extends from the bottom of elongated rib 17 upward and toward the top of the rib, but does not extend fully to the top of each elongated rib 17. A generally horizontal top slide surface 45 is formed at the top of each of protrusions 44 on elongated ribs 17. Top slide 45 acts to support each of flanges 32 formed on each footpad 25 as the footpad is moved along elongated track 40 toward and away from frame 8. Elongated track 40 also includes a plurality of intermediate ribs 47 which extend in a generally perpendicular direction between ribs 17, and are connected to each of the two elongated ribs 17 forming a portion of elongated track 40. As illustrated in FIG. 2, each of intermediate ribs 47 forms a slot 50 with protrusion 44 and top slide 45 in which the flanges 32 of each footpad 25 are held, thus supporting and holding each footpad 25 in elongated track 40.

Still referring to FIG. 2 a gap "g" is formed between the surface of top piece 30 and the bottom surface of intermediate rib 47, so that top surface 30 of footpad 25 does not engage the bottom of intermediate rib 47 as the footpad is moved into and out of frame 8. However, and as illustrated in FIG. 2, each of spherical stops 34 extends upward away from the surface of top piece 30 and engages each intermediate rib 47 as footpad 25 is moved along elongated track 40. Intermediate ribs 47 are constructed so that they are capable of being urged yieldably upward to permit spherical stops 34 to pass beneath intermediate rib 47. However, and as illustrated in FIG. 1 and 2, in its normal position, intermediate rib 47 will act as a stop abutting each of spherical stops 34 so that footpad 25 will not move or fall out of frame 8 unless it is intended to be moved into its extended position as shown generally in FIG. 1. Also, and as shown in FIG. 2, raised stop 36 passes beneath intermediate ribs 47, and abuts opening 42 in ends 11 or 12 of frame 8 when footpad 25 is moved into its generally horizontal extended position for use. Referring now to FIG. 1, each of openings 42 is constructed so that the openings can be urged yieldably upward to permit raised stop 36, and spherical stops 34, to pass through opening 42 as footpad 25 is being placed inside of frame 8.

Referring now to FIG. 1, each of elongated ribs 17 is spaced apart a distance, or a breadth, greater than the distance or breadth of top piece 30, including flanges 32, of each footpad 25. The breadth of elongated ribs 17 need be only slightly greater than the breadth of footpad 25, and acts as a frictional slide against the footpad, so that moderate force is required to move the footpad into and out of frame 8.

When it is desired to insert footpad 25 inside frame 8, rear end 28 of footpad 25 is positioned in opening 42 in ends 11 or 12 of frame 8. Footpad 25 is then moved inward along elongated track 40 so that raised stop 36, and spherical stops 34 pass through opening 42. As discussed above, opening 42 is sized and shaped so that it will be yieldably urged upward to permit raised stop 36 and spherical stop 34 to pass through opening 42. Once footpad 25 has been passed through opening 42, raised stop 36 will pass underneath each of intermediate ribs 47 in the space designated as gap "g", whereas spherical stops 34 will abut intermediate ribs 47 as they are moved along the track, and some force will be required to push the footpad into the frame so that each intermediate rib 47, in turn, is yieldably urged upward, or deflected upward, to permit the footpad to pass through the track. Once the footpad has been moved into the track, its progress into the track is stopped by lip 38 formed at the front end 36 of each footpad 25.

When it is desired to extend footpad or footpads 25 into their working or operating position, footpad 25 is help at front end 26. At this time, slotted recesses 31 may be used in helping the consumer grasp and extend footpad 25. As footpad 25 is moved along elongated track 40 and away from end 11 or 12 of frame 8, spherical stops 34 once again deflect each intermediate rib 47 upward so that the footpad may be passed along the track, until such time as raised stop 36 abuts the inside of opening 42 at end 11 or 12 of frame 8. If it is desired to replace a footpad 25, if, for example, one is broken, footpad 25 can be drawn outward and away from ends 11 or 12 of frame 8 until such time as opening 42 deflects to permit spherical stop 34 to pass therethrough, and thus the footpad is removed from the frame as illustrated in FIG. 1. It is intended that during normal operation, footpad 25 will at all times be held in elongated track 40 of frame 8, and will not pass through opening 42 and out of frame 8.

An alternate embodiment of device 1 is illustrated in FIGS. 3 through 5. In FIG. 3, device 1 is shown affixed to the bottom of the conventional wastebasket 2. As shown in FIGS. 4 and 5, however, in this embodiment each of footpads 25 is attached to frame 8 so that frame 8 and footpads 25 form one integral assembly.

As best shown in FIGS. 4 and 5, in this embodiment of device 1, an elongated hinge 60 extends along the rear end 28 of footpad 25, along top piece 30 from side to side of the footpad. Hinge 60 also extends along the corresponding portion of ends 11 and 12 of frame 8. As shown in FIG. 5, hinge 60 extends continuously along the rear end of pad 25, and ends 11 and 12 of frame 8, so that footpad 25 and frame 8 are formed as one integral assembly. This is also illustrated in FIG. 3 where it is shown that footpads 25 have been moved upward into their retracted position, and held in position by a piece of tape 65 against the side 5 of wastebasket 2, so that, for example, device 1 can be affixed to the bottom 3 of wastebasket 2 at the place where either device 1 or wastebasket 2 is manufactured, and a number of wastebaskets 2 with device 1 attached thereto can be stacked one inside the other, and shipped quickly and easily to a wholesaler or consumer for use. Once it reaches its desired location, tape 65 can be cut, and footpads 25 will spring downward into a generally horizontal extended position, shown in FIG. 4.

As illustrated in FIG. 4, device 1 in this alternate embodiment is otherwise similar to the preferred embodiment of device 1, illustrated in FIG. 1. Although it is anticipated that device 1 as illustrated in FIG. 4 can be attached to the bottom of a wastebasket in conventional fashion, it is also anticipated that the alternate embodiment of the device 1 illustrated in FIGS. 3 and 4 can be formed as an integral part of the bottom 3 of a wastebasket 2 during the manufacturing process. However, this is not necessary. It is a feature of this invention that this device, unlike some of the prior art devices, can be retrofit to any existing wastebasket without having to form a recess in the side walls of the wastebasket, or without cutting or forming a recess in the side walls of the wastebasket to which the device is fit.

Other features of this invention, as illustrated in FIGS. 1 and 4, are that footpads 25 are not pivotally attached to frame 8 with a spring or other means for urging the footpads into a retracted position, thus avoiding the problem of spring fatigue and failure at some point in the future.

Frame 8, to include sides 9 and 10, ends 11 and 12, ribs 17 and 18, and flanges 20, as well as footpad 25, to include front end 26, sides 27, rear end 28, flanges 32, raised stop 36, and lip 38 are formed of any conventional plastic material which is rigid and durable in structure. It is also possible to fabricate these parts from a lightweight metal or metal-alloy, aluminum being one example. For the embodiment of device 1 illustrated in FIGS. 3 through 5, it is anticipated that a generally flexible plastic material will be used so that hinge 60 can be formed as an integral part of device 1. Wastebasket 2, as illustrated in FIG. 3, can be any conventional wastebasket. Moreover, although frame 8 is shown in a generally rectangular configuration, it is understood by those skilled in the art that frame 8 can take any shape, for example, a circular shape, an octagonal shape, a hexagonal shape, any shape, that will correspond and match the shape of the wastebasket to which the device is attached. As discussed above, spherical stops 34 are metallic ball bearings. However, any hard and rigid material can be used to form spherical stops 34.

Although the preferred embodiments of the invention have been disclosed in the foregoing specification, it will be understood by those skilled in the art that variations and modifications thereof can be made without departing from the spirit and scope of the invention, as set forth in the following claims.

We claim:

1. A wastebasket liner removal device for use with a wastebasket, the wastebasket including a closed bottom, an open top, and at least one side wall joined to the bottom along their common edges for forming a receptacle to hold a removable wastebasket liner in the interior of the wastebasket, comprising:

a frame;

means for fastening said frame to the bottom of the wastebasket;

a plurality of footpads; and means for holding each of said footpads on said frame so that each footpad can be moved toward and away from said frame into a retracted position and into a generally horizontal extended position;

whereby said footpads are moved into their extended position so that the feet of the person removing the wastebasket liner can be placed thereon to hold the wastebasket in position as the wastebasket liner is drawn upward and out of the wastebasket without also lifting the wastebasket upward.

2. The device of claim 1, wherein there are two footpads opposed to one another on said frame.

3. The device of claim 1, wherein said frame comprises:

a pair of spaced apart sides;

a pair of spaced apart ends, said sides and ends being joined to one another along their common edges to form a generally rectangular frame;

and wherein said frame has a top and a bottom.

4. The device of claim 3, wherein said frame further comprises:

a plurality of elongated ribs intermediate the sides of said frame and extending between the ends of said frame, wherein said ribs are parallel to one another and to the sides of said frame;

a plurality of cross ribs intermediate the ends of said frame and extending between the sides of said frame, wherein said cross ribs are parallel to one another and to the ends of said frame.

5. The device of claim 3, wherein said means for fastening said frame to the bottom of the wastebasket comprises:

a plurality of coplanar mounting flanges formed in the top of said frame;

a fastener opening defined in each of said mounting flanges and passing therethrough for passing a fastener into the bottom of the wastebasket to fasten said frame to the wastebasket.

6. The device of claim 3, wherein said means for fastening said frame to the wastebasket comprises an integral frame and wastebasket assembly so that said frame is formed as an integral part of the bottom of the wastebasket.

7. The device of claim 3, wherein each of said footpads comprises:

two generally opposed sides;

a front end;

a rear end; and a top piece;

wherein said sides, ends, and top piece are joined to one another along their common edges to form a generally rectangular footpad.

8. The device of claim 7, wherein said means for holding each of said footpads on said frame comprises an elongated hinge extending continuously along the rear end of said footpad top piece and the corresponding end of said frame, so that one each of said footpads is formed as an integral part of the ends of said frame.

9. The device of claim 7, wherein each of said footpads further comprises a pair of elongated flanges formed one each along each side of the top piece, said flanges extending along the length of said footpad.

10. The device of claim 9, wherein each of said footpads includes:

a plurality of spherical stops, wherein each of said stops is partially recessed in the top piece of each footpad and extends upward away from the top piece; and a raised stop formed on each top piece adjacent the rear end of each footpad extending upward and away from the top piece.

11. The device of claim 10, wherein said spherical stops comprise ball bearings.

12. The device of claim 10, wherein said means for holding each of said footpads on said frame comprises:

an elongated track defined within said frame, wherein said track is sized and shaped to hold said footpads in said frame;

an opening defined in each end of said frame, wherein each of said openings is sized and shaped to receive said footpads, and wherein said openings are in communication with said track;

wherein said footpads are passed through said openings and into said track so that said footpads can be moved into their retracted and extended positions with respect to the frame along said track.

13. The device of claim 12, wherein said elongated track comprises:

a pair of elongated ribs forming the sides of the track, said ribs being spaced apart a distance of a breadth greater than the breadth of said footpads, wherein each of said ribs has an inwardly facing protrusion formed thereon, said protrusion having a generally horizontal top slide for supporting said flange formed along the sides of said footpads; and a plurality of intermediate ribs extending across the track between said elongated ribs and connected thereto, wherein said intermediate ribs are spaced above said top slides and form a slot with the top slide of each elongated rib along said track for guiding said footpads within the track.

14. The device of claim 13, wherein:

said intermediate ribs are spaced above the top piece of each of said footpads at a height sufficient to permit the top piece to pass underneath each of said intermediate ribs without engaging said ribs, wherein said intermediate ribs abut said spherical stops of said top pieces for holding said footpads in position relative to said frame when said footpads are in their retracted position, and wherein said intermediate ribs are sized and shaped to be urged yieldably upward to permit said spherical stops to pass underneath said ribs as said footpads are moved into their extended position;

wherein said openings defined in the ends of said frame are sized and shaped to abut said raised stop formed on the rear end of each top piece for holding the footpads in position relative to said frame when said footpads are in their extended position so that said footpads cannot be moved out of said frame;

and wherein said openings defined in the ends of said frame are sized and shaped to be urged yieldably upward as a footpad is passed through said opening into said track.

15. A wastebasket liner removal device for use with a wastebasket, the wastebasket including a closed bottom, an open top, and at least one side wall joined to the bottom along their common edges for forming a receptacle to hold a removable wastebasket liner in the interior of the wastebasket, comprising:

a frame;

means for fastening said frame to the bottom of the wastebasket;

a pair of opposed footpads attached to the frame, wherein said footpads are sized and shaped to be moved toward the frame into a retracted position, and away from the frame into a generally horizontal extended position;

whereby said footpads are moved into their extended position so that the feet of the person removing the wastebasket liner can be placed thereon to hold the wastebasket in position as the wastebasket liner is drawn upward and out of the wastebasket without also lifting the wastebasket upward.

16. The device of claim 15, wherein said means for fastening said frame to the bottom of the wastebasket comprises:

a plurality of coplanar mounting flanges formed in the top of said frame;

a fastener opening defined in each of said mounting flanges and passing therethrough for passing a fastener into the bottom of the wastebasket to fasten said frame to the wastebasket.

17. The device of claim 15, wherein said means for holding each of said footpads on said frame comprises an elongated hinge extending continuously along the rear end of said footpad top piece and the corresponding end of said frame, so that one each of said footpads is formed as an integral part of the ends of said frame.

18. A wastebasket liner removal device for use with a wastebasket, the wastebasket including a closed bottom, an open top, and at least one side wall joined to the bottom along their common edges for forming a receptacle to hold a removable wastebasket liner in the interior of the wastebasket, comprising:

a frame, wherein said frame is attached to the bottom of the wastebasket;

at least two footpads supported by the frame, wherein said footpads are disposed on the frame opposite one another, and wherein each footpad is sized and shaped to be moved toward and away from said frame into a retracted position and into a generally horizontal extended position;

elongated track means defined in said frame, said track means being sized and shaped to support said footpads in said frame;

an opening defined in said frame for each of said footpads, each of said openings being sized and shaped to receive one each of said footpads, wherein said openings are in communication with said track means;

wherein one each of said footpads is passed through one each of said openings and into said elongated track means so that said footpads can be moved into their retracted and extended positions along said track means with respect to the frame;

whereby said footpads are moved into their extended position along said track means so that the feet of the person removing the wastebasket liner can be placed on the footpads to hold the wastebasket in position as the liner is drawn upward and out of the wastebasket without also lifting the wastebasket upward.

* * * * *